US008826623B2

(12) United States Patent
Armstrong et al.

(10) Patent No.: US 8,826,623 B2
(45) Date of Patent: Sep. 9, 2014

(54) DIAGONAL BRACE CONNECTOR AND METHOD

(71) Applicants: James Armstrong, Orlando, FL (US); Brian Hall, Orlando, FL (US)

(72) Inventors: James Armstrong, Orlando, FL (US); Brian Hall, Orlando, FL (US)

( * ) Notice: Subject to any disclaimer, the term of this patent is extended or adjusted under 35 U.S.C. 154(b) by 0 days.

(21) Appl. No.: 13/894,381

(22) Filed: May 14, 2013

(65) Prior Publication Data

US 2014/0000184 A1 Jan. 2, 2014

Related U.S. Application Data

(60) Provisional application No. 61/646,589, filed on May 14, 2012.

(51) Int. Cl.

| | |
|---|---|
| ***E04C 2/38*** | (2006.01) |
| ***E04B 1/38*** | (2006.01) |
| ***E04C 3/02*** | (2006.01) |

(52) U.S. Cl.
CPC .... *E04C 3/02* (2013.01); *E04B 1/38* (2013.01)
USPC ..... 52/656.9; 52/695

(58) Field of Classification Search
USPC ..... 52/656.9, 167.3, 695, 648.1, 651.09, 52/653.1, 654.1, 655.1, 656.1, 690
See application file for complete search history.

(56) References Cited

U.S. PATENT DOCUMENTS

| | | | | |
|---|---|---|---|---|
| 4,503,640 | A * | 3/1985 | Stern | 49/425 |
| 4,706,650 | A * | 11/1987 | Matzkanin | 126/638 |
| 4,884,376 | A * | 12/1989 | DeBlock et al. | 52/92.2 |
| 4,958,468 | A * | 9/1990 | Nolan | 52/204.51 |
| 5,737,874 | A * | 4/1998 | Sipos et al. | 49/67 |
| 5,950,379 | A * | 9/1999 | Moore et al. | 52/204.5 |
| 6,430,888 | B1 * | 8/2002 | Dombchik et al. | 52/653.1 |
| 6,658,812 | B1 * | 12/2003 | Tomlinson et al. | 52/745.07 |
| 7,856,769 | B2 * | 12/2010 | Plaisted et al. | 52/173.3 |
| 8,225,561 | B2 * | 7/2012 | Voegele et al. | 52/204.595 |
| 8,256,170 | B2 * | 9/2012 | Plaisted et al. | 52/173.3 |
| 8,297,009 | B2 * | 10/2012 | Yamamoto | 52/173.3 |
| 8,528,281 | B2 * | 9/2013 | Boldt | 52/211 |
| 8,549,791 | B1 * | 10/2013 | Loughren et al. | 52/13 |

* cited by examiner

*Primary Examiner* — William Gilbert
*Assistant Examiner* — Gisele Ford

(57) ABSTRACT

A diagonal brace connector and method is disclosed. The connector includes an upper planar member and a lower planar member connected by a rigid webbing. A center screw boss is disposed continuously and laterally along the webbing. The screw boss is adapted to receive a screw fastened through a structural member and into the screw boss. A corner screw boss is along the corner between the webbing and the lower flange. The corner boss is similarly designed to accept a screw fastened through a structural member and into the screw boss. A pair of parallel grooves are formed in the webbing to provide a visual guide for the locations to install permanent fasteners. The alignment grooves are disposed such that the screw bosses of adjoining members do not interfere with the permanent fasteners.

8 Claims, 3 Drawing Sheets

FIG. 1
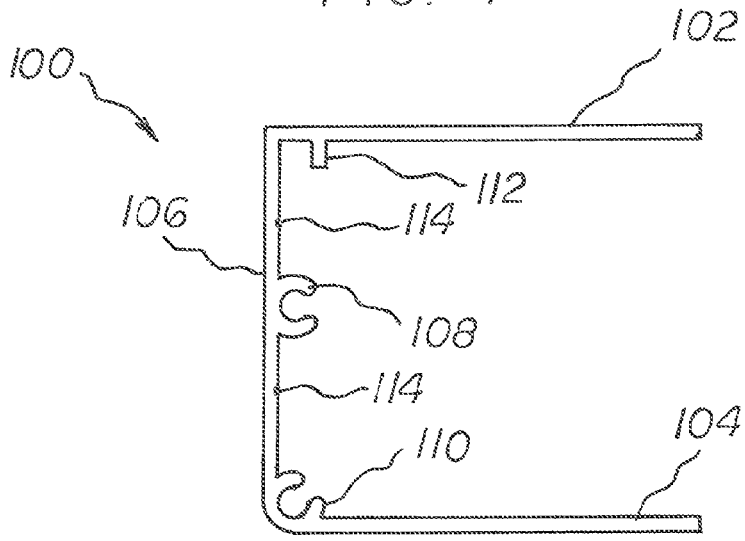
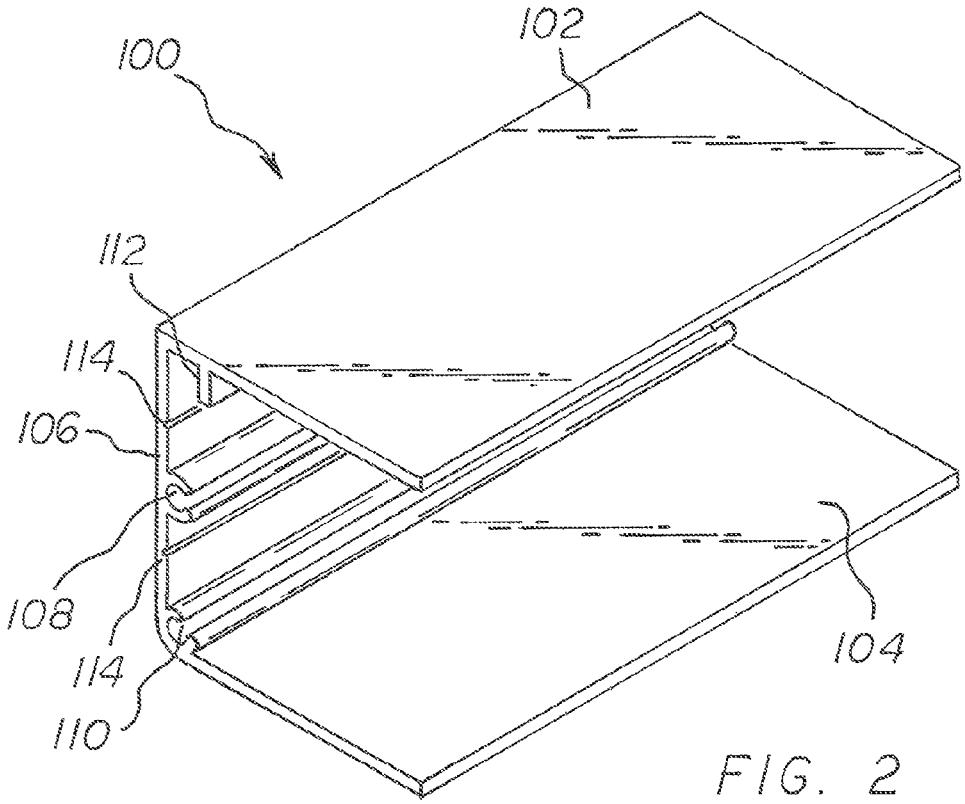
FIG. 2

FIG. 3A
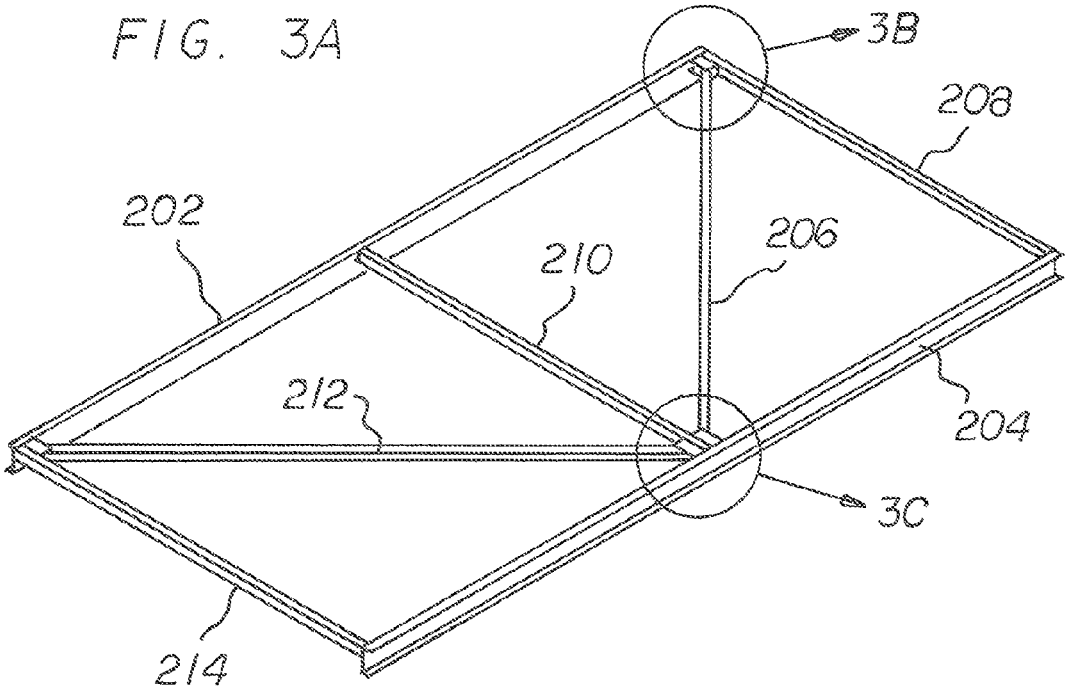
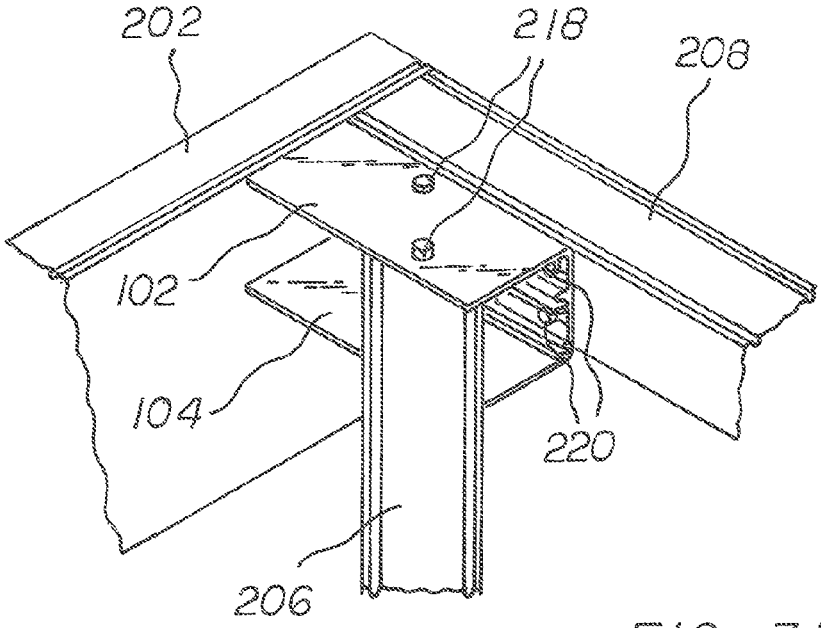
FIG. 3B

FIG. 3C
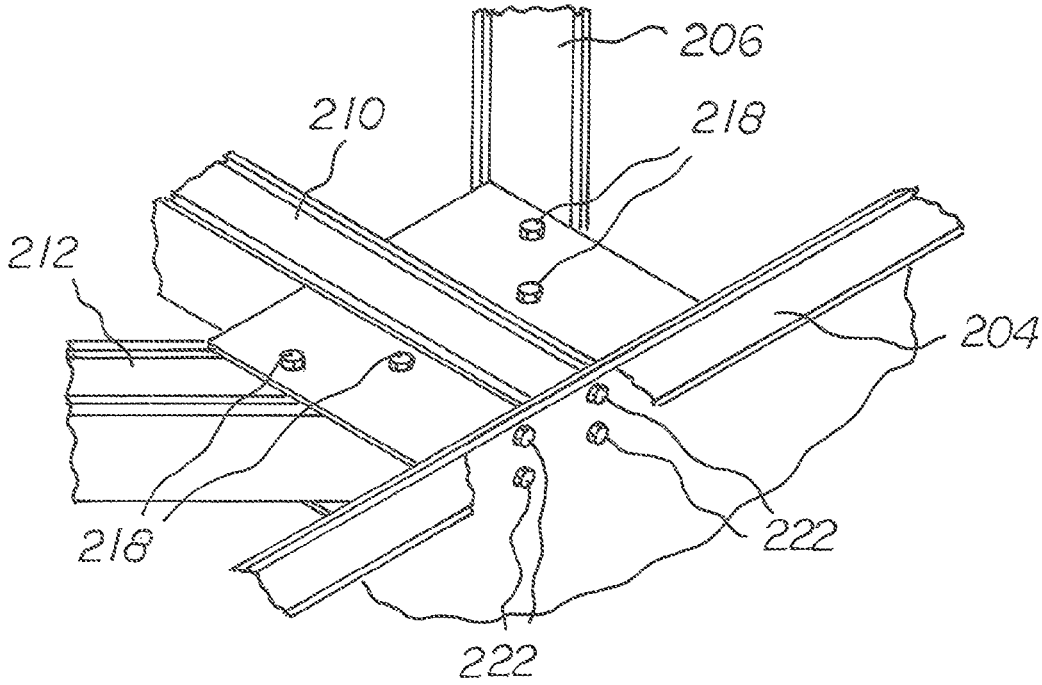
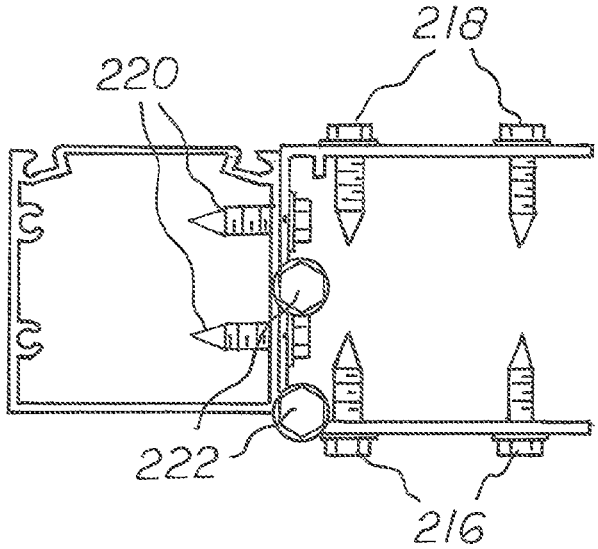
FIG. 4

DIAGONAL BRACE CONNECTOR AND METHOD

I. FIELD

The present disclosure is generally related to a diagonal brace connector and method.

II. DESCRIPTION OF RELATED ART

Individual aluminum structural members are joined together to form a rectangular framed panel. The framed panels are then joined together to form a larger structure. Typically, a diagonal brace structural member is used to join one corner of a frame panel to an opposing corner of the panel thereby bisecting the panel. The diagonal brace member promotes the ability of the frame panel to resist racking and increase structural integrity. The framed panels are then covered with a screening material used to prevent leaves and insects from entering the screened enclosure.

It is common in the industry that the diagonal bracing member is "toe-nailed" into the structural member of the frame to secure it in place. This means that the diagonal brace member is held adjacent to the structural member and a fastener, such as a screw, is angled through the diagonal brace member and the structural member to secure it in position. Although toe-nailing has been used previously, it is an undesirable attachment method due to its lack of strength in resisting shear and tension forces.

Moreover, there are additional undesirable consequences of existing methods of attaching diagonal brace members. For example, during the fabrication process the length of the diagonal bracing member is cut slightly short for the frame so that it can be adjusted and positioned within the frame as it is being installed. The diagonal bracing member is installed and secured to the frame by toe-nailing screws. The diagonal brace member allows the frame to be squared up and to account for any inconsistencies of the structural members.

Once the panels are fabricated, they are stacked and loaded on a truck and shipped to the jobsite. During the shipping process, a frame may become out of square and require an adjustment. Thus, the fasteners for the diagonal brace member would have to removed so that the diagonal brace member could be adjusted to bring the fame back into square then the fasteners reinstalled.

When installers are placing a panel at a jobsite to construct a larger structure, the diagonal bracing member prevents the panel from having the freedom of movement to allow the installers to fit the framed panel properly into position. This is especially detrimental in the installation of a roof panel, which causes the installers to go through a rigorous process of releasing the fasteners for the diagonal bracing enough so that there is a freedom of movement without dropping the diagonal brace member.

Accordingly, there is a need for an improved method and system of attaching diagonal bracing members that provides easier adjustment in the fabrication process. Further, there is a need for a more secure attachment of the diagonal bracing member that increases resistance to shear and tension forces. In addition, there is a need for a method and system to identify the location of installation for the fasteners for the diagonal bracing member. Another need exists in the art for an improved method of easily securing and adjusting diagonal brace members on the jobsite.

III. SUMMARY

In a particular embodiment, a diagonal brace connector and method is disclosed. The connector includes an upper planar member and a lower planar member connected by a rigid webbing. A center screw boss is disposed continuously and laterally along the webbing. The screw boss is adapted to axially receive a screw fastened through a structural member and into the screw boss. A corner screw boss is along the corner between the webbing and the lower flange. The corner boss is similarly designed to accept a screw fastened through a structural member and axially into the screw boss. A pair of parallel grooves are formed in the webbing to provide a visual guide for the locations to install permanent fasteners. The alignment grooves are disposed such that the screw bosses of adjoining members do not interfere with the permanent fasteners.

Other aspects, advantages, and features of the present disclosure will become apparent after review of the entire application, including the following sections: Brief Description of the Drawings and Detailed Description.

IV. BRIEF DESCRIPTION OF THE DRAWINGS

FIG. 1 is a side view of a particular illustrative embodiment of a diagonal brace connector;

FIG. 2 is a perspective view of the diagonal brace connector shown in FIG. 1;

FIG. 3*a* is a perspective view of a structural panel constructed with the diagonal brace connectors;

FIG. 3*b* is a partial view of a corner installed diagonal brace connector shown in FIG. 3*a;*

FIG. 3*c* is a partial view of the diagonal brace connector installed on both sides of a secondary structural member shown in FIG. 3*a*; and FIG. 4 is a side view of the diagonal brace channel secured to an adjacent structural member.

V. DETAILED DESCRIPTION

A first particular illustrative embodiment of a diagonal brace connector is disclosed in FIGS. 1 and 2 and generally designated 100. The C-shaped diagonal brace connector 100 includes an upper planar member 102 and a lower planar member 104 connected by a rigid webbing 106. A center screw boss is disposed continuously and laterally along the webbing 106. The screw boss 108 is adapted to receive a screw fastened through a structural member and into the screw boss 108. A corner screw boss 110 is along the corner between the webbing 106 and the lower flange 104. The corner boss 110 is similarly designed to accept a screw fastened through a structural member and into the screw boss 110. A pair of parallel grooves 114 are formed in the webbing 106 to provide a visual guide for the locations to install permanent fasteners. The alignment grooves 114 are disposed such that the screw bosses of adjoining members do not interfere with the permanent fasteners.

Referring now to FIG. 3*a*, the diagonal brace connector 100 is installed in a corner location (see FIG. 3*b*) of a structural panel and also at the junction of two diagonal brace members 206, 212 at a secondary structural member 210 (see FIG. 3*c*). The structural panel may include two or more primary structural members 202, 204 that are joined together to generally perpendicular secondary structural members 208, 210, 214. As shown in FIG. 3*a*, a rectangle shape is formed between the primary structural members 202, 204 and the secondary structural members 208, 210, 214, where a diagonal structural member 206, 212 is secured from a corner of the panel to an opposing diagonal corner of the panel where the secondary structural member 210 is attached. The diagonal structural members 206, 212 bisect the frame to provide additional structural support.

The corner installation of the diagonal brace connector 100 shown in FIG. 3*b* includes placing the connector 100 in the corner of the panel formed by the primary structural member 202 and secondary structural member 208. Once the connector 100 is in place, the connector 100 is fastened through the webbing 106 into the secondary structural member 208 typically using sheet metal screws 220 or other appropriate fasteners or securement means. The connector 100 is secured to the primary structural member 202 using sheet metal screws 222 fastened through the primary structural member 202 in screw bosses 108, 110 (see FIG. 3*c* and FIG. 4). The diagonal structural member 206 is secured to the connector 100 using sheet metal screws 218 fastened through the upper flange 102 and the lower flange 104. The upper flange 102 of the connector 100 is aligned with the top of the adjoining parallel structural member (e.g., secondary structural member 208) and the webbing of the perpendicular adjoining structural member (e.g. primary structural member 202) is pre-drilled with clearance holes using a drill template. The template may include a relatively thin piece of the profile (i.e., end) of the connector 100 to ensure that the screws will find the screw bosses 108, 110 on installation.

The installation of the connector 100 on both sides of the secondary structural member 210 is shown in FIG. 3*c*. The installation of the connector 100 is performed the same as described above where the connector 100 is secured to the primary structural member 204 using sheet metal screws 222 fastened through the primary structural member 204 in screw bosses 108, 110. The diagonal structural members 206, 210 are secured to the respective connectors 100 using sheet metal screws 216, 218 fastened through the upper flanges 102 and the lower flanges 104 of the connectors 100.

Referring now to FIG. 4, the connector 100 and a parallel adjacent structural member is shown. The adjoining member is typically a purlin used for secondary structural members but also can be a primary structural member such as a beam. For clarity, the primary structural member and diagonal structural members are not shown in FIG. 4 so that the installation of the fasteners 216, 218, 220, 222 used with the connector 100 are visible.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

What is claimed is:

1. A diagonal brace connector, the connector comprising:

a primary structural member; a secondary structural member disposed generally perpendicular to the primary structural member; a C-shaped member having a rigid webbing connecting an upper planar member and the lower planar member forming a C-shape;

a first screw fastened through the primary structural member and a center screw boss disposed continuously and laterally along the webbing, of the C-shaped member a second screw fastened through the primary structural member and a corner screw boss disposed along a corner between the webbing and the lower flange, of the C-shaped member; and a diagonal brace member bisects the primary and secondary structural member and is secured within a space of the C-shaped member formed between the upper planar member and the lower planar member.

2. The connector of claim 1, further comprising a pair of parallel alignment grooves etched in the webbing to provide a visual guide of locations to install permanent fasteners, wherein the alignment grooves are disposed on each side of the center screw boss to avoid the permanent fasteners of adjoining connectors secured using the center and corner screw bosses.

3. The connector of claim 2, wherein the permanent fasteners are sheet metal screws.

4. The connector of claim 3, wherein the connector is configured to fit in a corner location of a structural panel and a junction of two diagonal brace members at a secondary structural member.

5. The connector of claim 4, wherein the structural panel further comprising two or more primary structural members are joined together to generally perpendicular secondary structural members.

6. The connector of claim 5, wherein the connector is fastened through the rigid webbing to the secondary structural member and the connector is configured to be secured to the primary structural member through the primary structural member into the center and corner screw bosses.

7. The connector of claim 6, wherein the connector is secured to the diagonal structural member through the upper flange and the lower flange.

8. The connector of claim 7, wherein webbing of a perpendicular adjoining structural member is pre-drilled with clearance holes using a drill template.

* * * * *